US008043269B2

(12) United States Patent
Fourment et al.

(10) Patent No.: US 8,043,269 B2
(45) Date of Patent: Oct. 25, 2011

(54) CAP FOR A FLUID PRODUCT DISPENSING HEAD

(75) Inventors: Olivier Fourment, Paris (FR); Samuel Pruvot, Saint Etienne du Vauvray (FR)

(73) Assignee: Valois SAS, Le Neubourg (FR)

( * ) Notice: Subject to any disclaimer, the term of this patent is extended or adjusted under 35 U.S.C. 154(b) by 312 days.

(21) Appl. No.: 11/569,105

(22) PCT Filed: May 17, 2005

(86) PCT No.: PCT/FR2005/050334
§ 371 (c)(1),
(2), (4) Date: Nov. 14, 2006

(87) PCT Pub. No.: WO2005/113365
PCT Pub. Date: Dec. 1, 2005

(65) Prior Publication Data

US 2007/0221688 A1 Sep. 27, 2007

(30) Foreign Application Priority Data

May 17, 2004 (FR) ..... 04 50969

(51) Int. Cl.

| | |
|---|---|
| ***A61M 11/00*** | (2006.01) |
| ***A61M 5/00*** | (2006.01) |
| ***A61M 5/32*** | (2006.01) |
| ***A61M 25/00*** | (2006.01) |
| ***A61M 31/00*** | (2006.01) |
| ***B65D 39/00*** | (2006.01) |
| ***B65D 41/00*** | (2006.01) |
| ***B65D 43/00*** | (2006.01) |
| ***B65D 47/00*** | (2006.01) |
| ***B65D 51/00*** | (2006.01) |
| ***B65D 43/14*** | (2006.01) |
| ***B65D 51/04*** | (2006.01) |
| ***B65D 43/18*** | (2006.01) |
| ***B65D 3/00*** | (2006.01) |

(52) U.S. Cl. ..... 604/257; 128/200.14; 215/235; 215/236; 220/252; 220/810; 220/820; 220/821; 222/544; 222/556; 222/562; 604/111; 604/181; 604/182; 604/187; 604/192; 604/199; 604/263; 604/264; 604/266; 604/268; 604/275

(58) Field of Classification Search ..... 215/235, 215/236; 220/252, 810, 820, 821; 222/544, 222/553, 556, 557, 562; 604/111, 19, 257, 604/263, 27, 48, 93.01, 181, 187, 192, 264, 604/275, 198, 199, 266, 268, 278, 94.01; 128/200.14
See application file for complete search history.

(56) References Cited

U.S. PATENT DOCUMENTS 4,127,221 A * 11/1978 Vere ..... 222/153.02
(Continued)

FOREIGN PATENT DOCUMENTS

EP 0 621 199 A1 10/1994
(Continued)

*Primary Examiner* — Theodore Stigell
*Assistant Examiner* — Shefali Patel
(74) *Attorney, Agent, or Firm* — Sughrue Mion, PLLC

(57) ABSTRACT

A dispenser head for mounting on a fluid dispenser, said dispenser head comprising a body (1) provided with a dispenser orifice (10), said head being provided with a cap (2) that is displaceable between a closed position, in which it covers said dispenser orifice (10), and an open position, in which it does not cover said dispenser orifice, said cap (2) being connected in permanent manner to said body (1), regardless of the position of said cap.

23 Claims, 2 Drawing Sheets

U.S. PATENT DOCUMENTS

| | | | | | |
|---|---|---|---|---|---|
| 4,664,259 | A | * | 5/1987 | Landis | 206/365 |
| 4,790,442 | A | * | 12/1988 | Gach | 215/216 |
| 5,105,988 | A | * | 4/1992 | Knickerbocker | 222/148 |
| 5,207,657 | A | * | 5/1993 | Gibilisco | 604/295 |
| 5,232,127 | A | * | 8/1993 | Trotta et al. | 222/108 |
| 5,246,145 | A | * | 9/1993 | Leoncavallo et al. | 222/153.14 |
| 5,386,918 | A | * | 2/1995 | Neveras et al. | 215/235 |
| 5,547,091 | A | * | 8/1996 | Neveras et al. | 215/237 |
| 5,833,123 | A | * | 11/1998 | Gueret | 222/153.06 |
| 6,050,434 | A | * | 4/2000 | McNab | 215/235 |
| 6,669,055 | B1 | * | 12/2003 | Coleman et al. | 222/103 |
| 2002/0066755 | A1 | * | 6/2002 | Garibaldi | 222/524 |
| 2003/0057209 | A1 | * | 3/2003 | Seelhofer | 220/259.1 |
| 2003/0062369 | A1 | | 4/2003 | Hierzer et al. | |
| 2004/0050871 | A1 | * | 3/2004 | Delage | 222/212 |
| 2004/0065696 | A1 | | 4/2004 | Fletcher | |
| 2004/0069806 | A1 | | 4/2004 | Benoit-Gonin et al. | |

FOREIGN PATENT DOCUMENTS

| | | | |
|---|---|---|---|
| GB | 2 268 737 | A | 1/1994 |
| WO | 02/098756 | A2 | 12/2002 |
| WO | 03/095323 | A1 | 11/2003 |
| WO | 2004/007313 | A1 | 1/2004 |

* cited by examiner

CAP FOR A FLUID PRODUCT DISPENSING HEAD

CROSS REFERENCE TO RELATED APPLICATIONS

This patent application is the U.S. National Phase of International Application No. PCT/FR05/50334, having an international filing date of May 17, 2005, which claims priority to French Patent Application No. FR 0450969 filed on May 17, 2004.

BACKGROUND OF THE INVENTION (1) Field of the Invention

The present invention relates to a dispenser head for mounting on a fluid dispenser, and in particular to a head including a cap for selectively covering and uncovering a dispenser orifice, and it also relates to a dispenser provided with such a head.

(2) Description of Related Art

Putting a cap into place on a dispenser head generally fulfils several purposes. The first is to avoid the dispenser orifice becoming clogged between two actuation operations. The cap can also avoid fluid leaks. The cap can also avoid the fluid contained in the reservoir being in permanent contact with the surrounding ambient air, which could possibly cause microbiological contamination of the fluid that is to be delivered and/or cause a change in the chemical composition of said fluid. Thus, the purpose of caps found in the prior is selectively to mask and unmask a dispenser orifice through which fluid contained in a reservoir can escape following actuation by a user. Thus, the purpose of such caps is to cover the dispenser orifice while the user is not using the dispenser, and to uncover it by removal of said cap when the user desires to dispense a quantity of fluid. The cap is thus normally removed by the user exerting axial traction on the cap, so as to detach said cap completely from the dispenser head. However, the cap can be removed accidentally, e.g. while a dispenser is being carried in a bag, and this might result in liquid leaking into the bag. In addition, after using the dispenser, the user may omit to replace the cap on the dispenser head, and this might result in the negative consequences mentioned above.

BRIEF SUMMARY OF THE INVENTION

An object of the present invention is to mitigate the above-mentioned drawbacks of the prior art, and to define a dispenser head that is simultaneously simple to manufacture and to assemble, and that is of low cost.

An object of the present invention is thus to provide a dispenser head that limits in particular the risk of the dispenser orifice becoming clogged, of fluid leaking, and of fluid being contaminated between two actuation operations.

Another object of the present invention is to provide such a head that is easy to operate, and that can possibly be manipulated using one hand only.

The present invention thus proposes a dispenser head for mounting on a fluid dispenser, said dispenser head comprising a body provided with a dispenser orifice, said head being provided with a cap that is displaceable between a closed position, in which it covers said dispenser orifice, and an open position, in which it does not cover said dispenser orifice, said cap being connected in permanent manner to said body, regardless of the position of said cap.

Advantageously, said cap is connected to said body via a bridge of material.

Advantageously, said bridge of material forms a hinge about which said cap pivots between its two positions.

According to an advantageous characteristic of the invention, said bridge of material is provided on, or in the proximity of, the periphery of a radial flange that forms an actuator surface for actuating said head. A dispenser head is thus provided that includes a cap, which, when tilted into its open position, does not hinder the user in any way when said user desires to compress the actuator surface so as to expel a quantity of fluid, the cap being offset completely from the actuator surface.

According to another advantageous characteristic of the invention, said cap, in its closed position, before the dispenser is used for the first time, includes a first-use guarantee and/or indicator. This advantageous characteristic makes it possible to guarantee that the dispenser has not been used, and therefore guarantee the accuracy of the contents of said dispenser, and its sterility.

Advantageously, said first-use guarantee and/or indicator is formed by a portion of the cap that is for breaking off, tearing off, or separating from the cap during first use, when the cap moved for the first time from its closed position.

Advantageously, said first-use guarantee and/or indicator includes a projection that is connected to said cap, and that co-operates with the peripheral edge of said radial flange, said projection needing to be broken off, torn off, or separated from said cap, so as to enable said cap to pass from its initial closed position to its open position.

According to another advantageous characteristic of the invention, said cap includes at least one side opening. This characteristic makes it easier in particular to pivot the cap relative to the body, between both of its positions, in particular for a nasal dispenser head.

Advantageously, said dispenser orifice is provided in an axial extension of said body, said axial extension passing through said opening while the cap is being displaced between its closed and open positions. This makes it possible to make a cap having dimensions that are close to the dimensions of the dispenser head, while being held captive, and in particular pivotally mounted on said head, in particular when the head is of the nasal type.

According to another advantageous characteristic of the invention, said opening promotes drying the fluid at the dispenser orifice when the cap is in its closed position.

According to another advantageous characteristic of the invention, said cap includes an external trigger, making it easier to manipulate the cap.

Advantageously, said trigger is situated in register with said opening. This makes it easier to actuate the cap.

Advantageously, said head is a nasal dispenser head for inserting in a nostril.

The present invention also proposes a fluid dispenser comprising: a fluid dispenser member, such as a pump or a valve; a fluid reservoir; and a dispenser head as described above.

It should be noted that the characteristics claimed in the various claims can be considered independently of one another. Thus, a side opening could be used independently of a hinge about which the cap pivots, for example, and a trigger could be used independently of a side opening in the cap.

The invention is described more fully below with reference to the accompanying drawings which show an embodiment of the invention by way of non-limiting example.

DETAILED DESCRIPTION OF THE PREFERRED EMBODIMENTS

Figure 1:
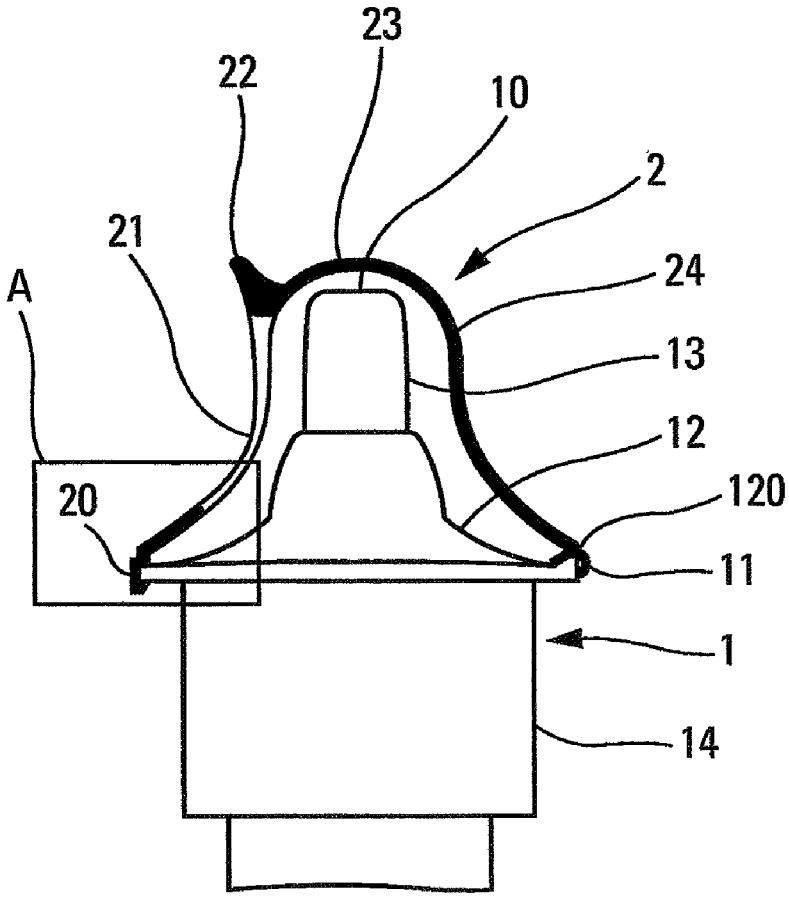
FIG. 1 is a diagrammatic section view of a dispenser head provided with a cap, and constituting an embodiment of the present invention in its initial closed position.

In the figures, a nasal dispenser head is shown, but naturally the present invention applies to any type of dispenser or spray head. The head comprises a body 1 provided with a dispenser orifice 10, and this fluid dispenser head is generally for mounting on a dispenser member that is capable of extracting fluid contained in a reservoir. By way of example, the dispenser member can be a pump or a valve fastened on a reservoir. A protective cap 2 is associated with said head, said cap being displaceable between a closed position (FIG. 1), in which it covers the dispenser orifice 10, and an open position (FIG. 3), in which it does not cover said orifice. In the invention, regardless of its position, the cap is connected in permanent manner to said body, the cap thus being held captive.

In the example shown of a nasal head, the body 1 includes an axial extension 13 of substantially cylindrical or conical configuration, provided with the dispenser orifice 10 at its end. In a variant, the dispenser orifice 10 could also be situated laterally, e.g. for use in the mouth. Advantageously, the axial extension 13 internally defines a duct that is suitable for putting the dispenser orifice into communication with the dispenser member (not shown). The axial extension 13 is advantageously extended by a portion that flares outwards, and that is suitable for forming a substantially radial flange 12. Depending on the use envisaged for the dispenser head, either the axial extension 13 or the radial flange 12 can form an actuator surface on which a user exerts a force, so as to cause a dose of fluid to be dispensed.

A skirt 14 of advantageously-cylindrical shape extends downwards from said radial flange 12. The skirt advantageously extends around the neck of the reservoir (not shown), with its bottom end being suitable for coming into abutment against the reservoir, so as to define an abutment to the axial movement in translation of the dispenser head during actuation.

Advantageously, the cap 2 is generally bell shaped. The cap 2 includes a top 23 from which there extend side walls 24 having bottom ends that together form an annular ring 25 that is suitable for coming to bear against the radial flange 12 of said body 1. The annular ring 25 can co-operate by friction with the outer edge of the flange 12, so as to hold the cap in the closed position, and so as to force the user to overcome this friction in order to open said cap.

Figure 3:
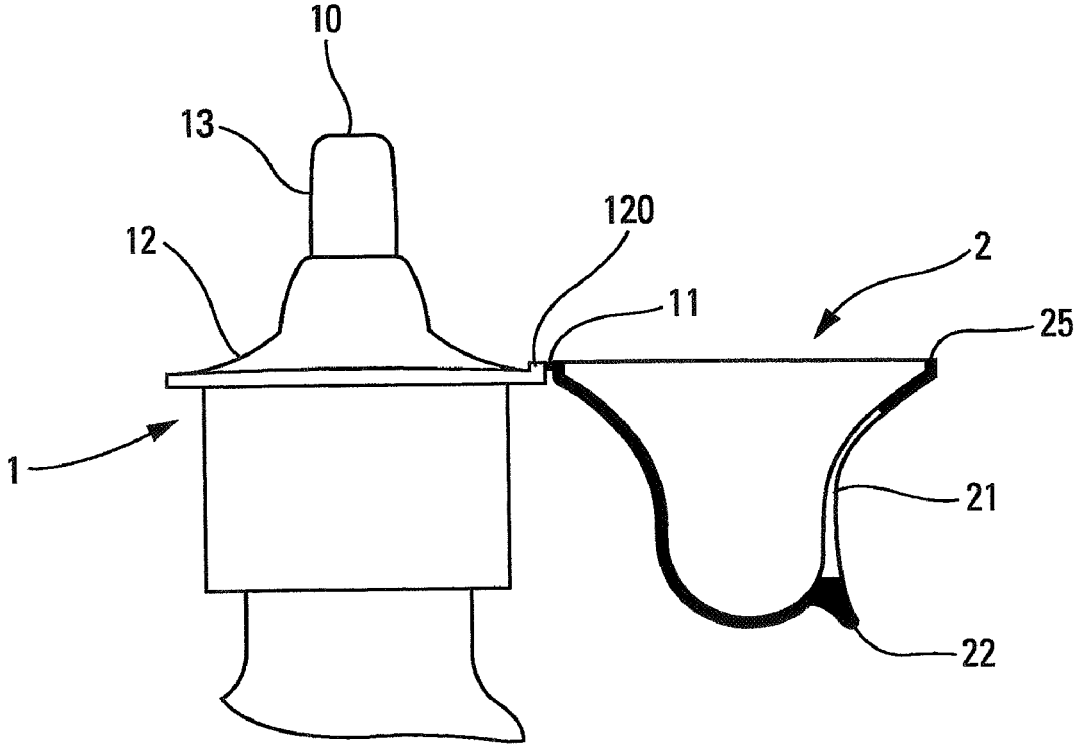
FIG. 3 is a view similar to the views in FIGS. 1 and 2, but in the open position.

The permanent connection of the cap with the head is advantageously formed by a bridge of material 11 that connects the cap 2 in permanent manner to said body 1. The bridge of material 11 preferably constitutes a hinge about which said cap pivots, so as to cover or uncover in selective manner the dispenser orifice 10, thereby defining the closed position and the open position respectively. The hinge 11 is advantageously situated at the margin of the actuator surface, preferably at the peripheral edge 120 of the radial flange 12. The disposition of the hinge 11 at the periphery of the flange 12 thus makes it possible to displace the cap 2 relative to said body 1 in such a manner that said cap 2 moves into its open position facing the skirt 14, as can be seen in FIG. 3. This particularly advantageous disposition of the hinge 11 thus provides a location for the cap 2, in its open position, that does not in any way hinder access to the radial flange 12 that is intended to be compressed so as to deliver a dose of fluid. The bridge of material 11 can be made in such a manner that it urges the cap resiliently towards its closed position, with the user having to overcome this elastic force in order to open the cap.

A trigger 22 is advantageously provided on said cap, so as to make it easier to manipulate, i.e. to move the cap from one position to another. The trigger 22 advantageously forms a projecting crest that the user can easily grasp, so as to displace said cap 2. This displacement can even be performed using one hand, with the thumb of the user possibly coming to press on said trigger, for example, thereby pivoting the cap into its open position. More generally, both opening the cap and actuating the dispenser can be performed using one hand.

The cap 2 advantageously includes at least one side opening 21. The trigger 22 advantageously overhangs the side opening 21. The side opening 21 can present any shape: round, oval, elliptical, ellipsoidal, rectangular, square, etc. It is preferably of a size that is sufficient for the axial extension 13 not to hinder or block the pivoting of the cap 2. The side opening 21 also presents the advantage of airing the inside of the cap 2 in its closed position, and can thus promote the drying of any fluid that might remain in the proximity of the dispenser orifice 10 after fluid has been dispensed. The presence of the opening 21 in the cap makes it possible to make a cap having dimensions that are close to the dimensions of the head, even when said head is a nasal head having an axial extension 13 that might be long, while being held captive, and in particular while being pivotally mounted on said head.

Figure 4:
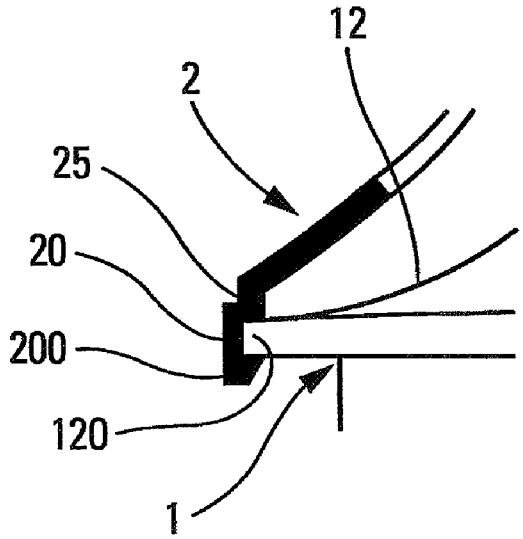
FIG. 4 is a fragmentary view of a detail A of FIG. 1.
Figure 2:
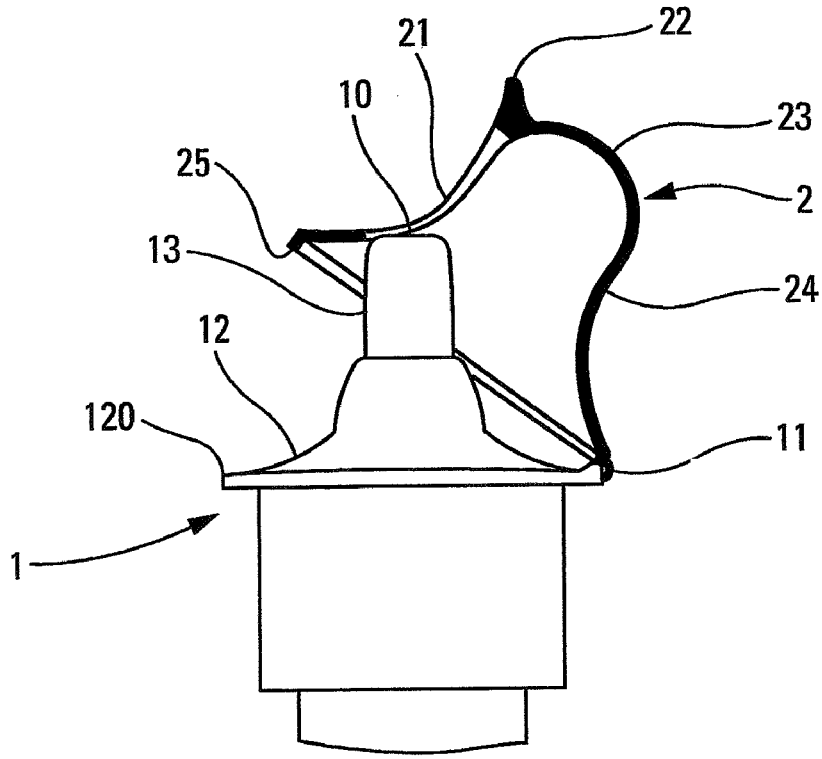
FIG. 2 is a view similar to the view in FIG. 1, but in the half-open position.

Furthermore, as shown in more detailed manner in FIG. 4, the cap advantageously includes a first-use guarantee and/or indicator 20. The first-use guarantee and/or indicator 20 constitutes a tamper-proofing device that indicates that the cap 2 has remained in its closed position until it is first used by the user, and therefore indicates that no fluid has been dispensed beforehand. This guarantees both the amount of fluid that is contained in the reservoir, and its sterility. The first-use guarantee and/or indicator is advantageously secured to said cap on the annular ring 25, and can comprise a projection 200 that is suitable for coming to bear against the peripheral edge 120 of the radial flange 12. The projection 200 is advantageously lodged under the peripheral edge 120, so as to prevent the cap from pivoting out of its closed position. Thus, pivoting the cap, and accessing the radial flange 12 that forms the actuator surface, can take place only after the projection 200 has been broken off, torn off, or separated from said cap. The cap 2 could thus pass freely from the closed position, masking the dispenser orifice 10, to an open position, unmasking said orifice 10, by pivoting about said hinge 11.

Advantageously, the cap can also include anti-actuation means, which, when the cap is in the closed position, prevent the dispenser member (e.g. a pump) from being actuated, and which, when the cap is in the open position, enable said actuation. For example, the cap could include an extension or projection that is adapted to co-operate, in the closed position, with a portion of the reservoir or an element that is secured thereto, so as to form a mechanical abutment, preventing actuation. Other variant embodiments can also be envisaged.

Thus, the embodiment described of the dispenser head uses a cap that is secured in permanent manner to a body, regardless of the position of said cap, so as to make it unseparable from said body, and thus held captive. In addition, the cap enables a first-use indicator system to be made in simple manner.

It should be noted that various modifications could be applied to the invention by a person skilled in the art, without going beyond the ambit of the invention, as defined in the accompanying claims.

The invention claimed is:

1. A dispenser head for mounting on a fluid dispenser, said dispenser head comprising a body (1) provided with a dispenser orifice (10), said head being provided with a cap (2) that is displaceable between a closed position, in which the cap covers said dispenser orifice (10), and an open position, in which the cap does not cover said dispenser orifice, wherein said cap (2) is connected in permanent manner to said body (1), regardless of the position of said cap, said cap (2) including at least one side opening (21), said side opening forming a hole through a side wall of the cap, said dispenser orifice (10) being provided on a distal end of an axial extension (13) of said body (1) such that the body of the dispenser head is configured as a nasal dispenser head for insertion in a nostril, said axial extension (13) passing through said side opening (21) while the cap (2) is being displaced between the closed position and the open position;

wherein the dispenser head is attached to a pump or a valve for dispensing a fluid product;

wherein the pump or the valve is actuated by the dispenser head; and wherein the axial extension (13) flares outwards to form a substantially radial flange (12) forming an actuator surface on which the user exerts a force to actuate the dispenser.

2. A dispenser head according to claim 1, in which said cap is connected to said body (1) via a bridge of material (11).

3. A dispenser head according to claim 2, in which said bridge of material (11) forms a hinge about which said cap pivots between the open position and the closed position.

4. A dispenser head according to claim 2, in which said bridge of material (11) is provided on, or in the proximity of, the periphery of said radial flange (12) that forms said actuator surface for actuating said head.

5. A dispenser head according to claim 4, further comprising a first-use guarantee and/or indicator (20) comprising a projection (200) connected to said cap (2), wherein the first-use guarantee and/or indicator co-operates with the peripheral edge (120) of said radial flange (12), said projection (200) needing to be broken off, torn off, or separated from said cap, so as to enable said cap (2) to pass from an initial closed position to the open position.

6. A dispenser head according to claim 1, in which said cap (2), in the closed position, before the dispenser is used for the first time, includes a first-use guarantee and/or indicator (20).

7. A dispenser head according to claim 6, in which said first-use guarantee and/or indicator (20) is formed by a portion of the cap (2) that is for breaking off, tearing off, or separating from the cap (2) during first use, when the cap (2) is moved for the first time from the closed position.

8. A dispenser head according to claim 1, in which said opening (21) promotes drying the fluid at the dispenser orifice (10) when the cap (2) is in the closed position.

9. A dispenser head according to claim 1, in which said cap (2) includes an external trigger (22), making it easier to manipulate the cap (2).

10. A dispenser head according to claim 9, in which said trigger (22) is situated in register with said opening (21).

11. A fluid dispenser comprising: a fluid reservoir; and a dispenser head according to claim 1.

12. A dispenser head according to claim 1, wherein a shape of the cap substantially follows contours of the body.

13. A dispenser head according to claim 1, wherein the distal end of the axial extension passes through the side opening.

14. The dispenser head according to claim 1, wherein the axial extension is configured to be contained inside of the cap when the cap is in the closed position.

15. The dispenser head according to claim 1, wherein the side opening connects an interior of the cap to an exterior of the cap when the cap is in the closed position.

16. The dispenser head according to claim 1, wherein the cap comprises a top (23) from which extends a lateral wall (24), the bottom end of said lateral wall forming an annular ring (25).

17. The dispenser head according to claim 16, wherein the at least one side opening (21) is formed in the lateral wall.

18. The dispenser head recited in claim 1, wherein the dispenser head is a spray head configured to emit a spray.

19. The dispenser head recited in claim 1, wherein the axial extension and radial flange are a one-piece unitary construction.

20. The dispenser head recited in claim 1, wherein the axial extension terminates in a smooth blunt surface having no sharp points.

21. A fluid dispenser comprising:

a pump or a valve for dispensing a fluid product;

a head attached to the pump or the valve, the head comprising:

a body;

an axial extension configured as a nasal dispenser for insertion into a nostril to dispense the fluid product; and a dispenser orifice provided on a distal end of the axial extension;

a cap displaceable between a closed position, in which the cap covers the dispenser orifice, and an open position, in which the cap does not cover said dispenser orifice, the cap being permanently connected to the body and comprising at least one side opening;

wherein the distal end of the axial extension extends through the side opening while the cap is being displaced between the closed position and the open position;

wherein the side opening forms a hole through a side wall of the cap; and wherein the axial extension flares outwards to form a substantially radial flange forming an actuator surface on which the user exerts a force to actuate the dispenser.

22. The fluid dispenser according to claim 21, wherein the side opening connects an interior of the cap to an exterior of the cap when the cap is in the closed position.

23. The fluid dispenser according to claim 21, wherein the cap comprises an annular ring that cooperates with the body so as to hold the cap in the closed position.

* * * * *